US005904298A

United States Patent [19]

Kwok et al.

[11] Patent Number: 5,904,298

[45] Date of Patent: May 18, 1999

[54] MELTBLOWING METHOD AND SYSTEM

[75] Inventors: Kui-Chiu Kwok, Mundelein, Ill.; Edward W. Bolyard, Jr., Old Hickory; Leonard E. Riggan, Jr., Nashville, both of Tenn.

[73] Assignee: Illinois Tool Works Inc., Glenview, Ill.

[21] Appl. No.: 08/843,224

[22] Filed: Apr. 14, 1997

Related U.S. Application Data

[63] Continuation-in-part of application No. 08/717,080, Oct. 10, 1996.

[51] Int. Cl.[6] ..... B05B 1/28

[52] U.S. Cl. ..... 239/135; 239/11; 239/124; 239/292; 239/296; 239/596

[58] Field of Search ..... 239/124, 11, 290, 239/292, 296, 418, 390, 391, 553, 553.3, 553.5, 555, 590, 590.3, 590.5, 596

[56] References Cited

U.S. PATENT DOCUMENTS

| | | |
|---|---|---|
| Re. 33,158 | 2/1990 | Stouffer et al. . |
| Re. 33,159 | 2/1990 | Bauer . |
| Re. 33,448 | 11/1990 | Bauer . |
| Re. 33,481 | 12/1990 | Zeicker et al. . |
| Re. 33,605 | 6/1991 | Bauer . |
| 2,031,387 | 11/1936 | Schwarz . |
| 2,212,448 | 8/1940 | Modigliani . |
| 2,297,726 | 4/1942 | Stephanoff . |
| 2,628,386 | 2/1953 | Tornberg . |
| 3,038,202 | 6/1962 | Harkenrider . |
| 3,176,345 | 4/1965 | Powell . |
| 3,178,770 | 4/1965 | Willis . |
| 3,192,562 | 7/1965 | Powell . |
| 3,192,563 | 7/1965 | Crompton . |
| 3,204,290 | 9/1965 | Crompton . |
| 3,213,170 | 10/1965 | Erdmenger et al. . |
| 3,253,301 | 5/1966 | McGlaughlin . |
| 3,334,792 | 8/1967 | DeVries et al. . |

(List continued on next page.)

FOREIGN PATENT DOCUMENTS

| | | |
|---|---|---|
| 4416168 | 7/1969 | Japan . |
| 756907 | 9/1956 | United Kingdom . |
| 1392667 | 4/1975 | United Kingdom . |
| WO9315895 | 8/1993 | WIPO . |

OTHER PUBLICATIONS

Gregory F. Ward, "Micro–Denier Nonwoven Process and Fabrics", on or about Oct. 17, 1997, pp. 1–9.

Nonwovens World Magazine, "Meltblown Technology Today", 1989, pp. 1–158.

The New Non–Wovens World, "Developments in Melt Blowing Technology", Summer 1993, pp. 73–82.

Scott R. Miller, Beyond Meltblowing: Process Refinement in Microfibre Hot melt adhesive Technology, Edana 1998 International Nonwovens Symposium, 11 pp.

Edward K. McNally et al., J & M Laboratories, "Durafiber®/Durastitch™ Adhesives Applications Method Featureing Solid State Application Technology", disclosed on Sep. 8, 1997 at Inda–Tec 97 Meeting, Cambridge MA, pp. 26.1–26.8.

*Primary Examiner*—Andres Kashnikow
*Assistant Examiner*—Robin O. Evans

[57] ABSTRACT

A meltblowing method and system for dispensing first and second fluids from corresponding first and second orifices of a die assembly to form a meltblown first fluid filament. The die assembly directs the first and second fluid flows parallelly, or divergently, or directs two second fluid flows convergently toward a common first fluid flow, whereby the first and second fluids are dispensed from orifices at equal first fluid flow rates and equal second fluid flow rates. The die assembly is compressably retained between opposing end plates coupled to an adapter for further coupling to a main manifold having a fluid metering device for supplying first fluid to the die assembly. The meltblown filaments are depositing onto a moving substrate by vacillating the filament non-parallel to a direction of substrate movement, whereby vacillation a first fluid flow is controllable by an angle between the first fluid flow and one or more flanking second fluid flows, among other variables.

53 Claims, 4 Drawing Sheets

U.S. PATENT DOCUMENTS 3,380,128 4/1968 Cremer et al. .
3,488,806 1/1970 De Cecco et al. .
3,492,692 2/1970 Soda et al. .
3,501,805 3/1970 Douglas, Jr. et al. .
3,613,170 10/1971 Soda et al. .
3,650,866 3/1972 Prentice .
3,704,198 11/1972 Prentice .
3,755,527 8/1973 Keller et al. .
3,825,379 7/1974 Lohkamp et al. .
3,849,241 11/1974 Butin et al. .
3,861,850 1/1975 Wallis .
3,874,886 4/1975 Levecque et al. .
3,888,610 6/1975 Brackmann et al. .
3,920,362 11/1975 Bradt .
3,923,444 12/1975 Esper et al. .
3,942,723 3/1976 Langdon .
3,947,537 3/1976 Buntin et al. .
3,970,417 7/1976 Page .
3,978,185 8/1976 Buntin et al. .
3,981,650 9/1976 Page .
4,007,625 2/1977 Houben et al. .
4,015,963 4/1977 Levecque et al. .
4,015,964 4/1977 Levecque et al. .
4,050,866 9/1977 Kilsdonk .
4,052,002 10/1977 Stouffer et al. .
4,052,183 10/1977 Levecque et al. .
4,100,324 7/1978 Anderson et al. .
4,145,173 3/1979 Pelzer et al. .
4,151,955 5/1979 Stouffer .
4,185,981 1/1980 Ohsato et al. .
4,189,455 2/1980 Raganato et al. .
4,457,685 7/1984 Huang et al. .
4,596,364 6/1986 Bauer .
4,652,225 3/1987 Dehennau et al. .
4,694,992 9/1987 Stouffer .
4,746,283 5/1988 Hobson .
4,747,986 5/1988 Chao .
4,812,276 3/1989 Chao .
4,818,464 4/1989 Lau .
4,826,415 5/1989 Mende .
4,905,909 3/1990 Woods .
4,949,668 8/1990 Heindel et al. .
4,955,547 9/1990 Woods .
4,983,109 1/1991 Miller et al. ..... 239/553.5 X
5,013,232 5/1991 Way .
5,017,116 5/1991 Carter et al. .
5,035,361 7/1991 Stouffer .
5,067,885 11/1991 Stevenson et al. .
5,069,853 12/1991 Miller .
5,094,792 3/1992 Baran .
5,114,752 5/1992 Hall .
5,129,585 7/1992 Bauer .
5,207,970 5/1993 Joseph et al. .
5,260,003 11/1993 Nyssen et al. .
5,342,647 8/1994 Heindel et al. .
5,354,378 10/1994 Hauser et al. .
5,407,619 4/1995 Maeda et al. .
5,409,733 4/1995 Boger et al. .
5,418,009 5/1995 Raterman et al. .
5,421,921 6/1995 Gill et al. .
5,421,941 6/1995 Allen et al. .
5,423,935 6/1995 Benecke et al. .
5,429,840 7/1995 Raterman et al. .
5,458,291 10/1995 Brusko et al. ..... 239/423
5,503,784 4/1996 Balk .
5,524,828 6/1996 Raterman et al. .
5,533,675 7/1996 Benecke et al. .
5,605,706 2/1997 Allen et al. .
5,618,347 4/1997 Clare et al. .
5,618,566 4/1997 Allen et al. .
5,620,139 4/1997 Ziecker et al. ..... 239/124
5,679,379 10/1997 Fabbricante et al. .

MELTBLOWING METHOD AND SYSTEM

CROSS REFERENCE TO RELATED APPLICATIONS

The present application is related to copending U.S. application Ser. No. 08/683,064 filed Jul. 16, 1996, entitled "Hot Melt Adhesive Applicator With Metering Gear-Driven Head", and copending U. S. application Ser. No. 08/734,400 filed Oct. 16, 1996, entitled "Fluid Flow Control Plates For Hot Melt Adhesive Applicator", and is a continuation-in-art of copending U. S. application No. 08/717,080 filed Oct. 10, 1996, entitled "Meltblowing Method and Apparatus", all of which are commonly assigned and incorporated herein by reference.

BACKGROUND OF THE INVENTION

The invention relates generally to meltblowing methods and systems, and more particularly to parallel plate meltblowing die assemblies and meltblowing system configurations useable for precisely controlling the dispensing and uniform application of meltblown adhesive filaments onto moving substrates.

Meltblowing is a process of forming fibers or filaments by drawing and attenuating a first fluid flow with shear forces from adjacent relatively high velocity second fluid flows. Molten thermoplastic flows, for example, may be drawn and attenuated by heated air flows to form meltblown thermoplastic filaments. Generally, meltblown filaments may be continuous or discontinuous, and range in size between several tenths of a micron and several hundred microns depending on the meltblown material and application requirements. Early applications for meltblowing processes included the formation of non-woven fabrics from meltblown filaments drawn to vacillate chaotically.

More recently, meltblowing processes have been used to form meltblown adhesive filaments for bonding substrates in the production of a variety of bodily fluid absorbing hygienic articles like disposable diapers and incontinence pads, sanitary napkins, patient underlays, and surgical dressings. Many of these applications, however, require a relatively high degree of control over the dispensing and application of the meltblown filaments, particularly meltblown adhesives deposited onto substrates which are extremely temperature sensitive. But meltblown filaments drawn to vacillate chaotically are not generally suitable for these and other applications requiring increased control over the dispensing and application of the meltblown filaments.

The referenced copending U.S. application Ser. No. 08/717,080 filed Oct. 10, 1996 entitled "Meltblowing Method and Apparatus" incorporated by reference herein marked a significant advance in meltblowing technologies, and particularly for meltblowing applications requiring relatively precise control over the dispensing of individual meltblown filaments onto moving substrates. The referenced copending application is drawn generally to parallel plate die assemblies having a plurality of adhesive and air dispensing orifices arranged in a variety of spatial configurations for dispensing meltblown adhesives, and more particularly for relatively precisely controlling frequency and amplitude parameters of individual meltblown filaments to provide selective and uniform application of the filaments onto moving substrates.

The present invention is drawn to further advances in meltblowing technology, and is applicable to the dispensing of meltblown adhesive filaments onto moving substrates, especially in the production of bodily fluid absorbing hygienic articles.

It is thus an object of the invention to provide novel methods and systems for practicing meltblowing processes, and more particularly for applying meltblown adhesives onto moving substrates.

It is another object of the invention to provide novel methods and systems for practicing meltblowing processes by dispensing first and second fluids from corresponding first and second orifices of a die assembly to form second fluid flows along substantially opposing flanking sides of a first fluid flow, whereby the first fluid flow is drawn and attenuated to form a first fluid filament. A more general object of the invention is to dispense the first fluid from a plurality of first orifices and the second fluid from a plurality of second orifices to form a plurality of first and second fluid flows arranged in an array, whereby the plurality of first fluid flows are drawn and attenuated to form a plurality of first fluid filaments.

It is also an object of the invention to provide novel methods and meltblowing die assemblies for directing first and second fluid flows parallelly, or divergently, and it is another object of the invention to provide die assemblies for directing two second fluid flows convergently toward a common first fluid flow whereby the first fluid flow is directed parallelly or divergently relative to other first fluid flows. It is a related object of the invention to dispense first and second fluid flows having equal first fluid mass flow rates and equal second fluid mass flow rates to provide more uniform dispensing and control over the meltblown filaments.

It is a further object of the invention to provide novel methods and systems for practicing meltblowing processes by depositing first meltblown fluid filaments onto a moving substrate by vacillating the filaments non-parallel to a direction of substrate movement, and more generally depositing a plurality first fluid filaments onto a moving substrate by vacillating some of the plurality of first fluid filaments non-parallel and other filaments parallel to a direction of substrate movement. It is a related object of the invention to control vacillation parameters of a first fluid flow by an angle between the first fluid flow and one or more flanking second fluid flows, among other variables.

It is another object of the invention to provide novel methods and meltblowing die assemblies comprising a plurality of at least two parallel plates compressably retained between first and second end plates, and it is a related object of the invention to dispose a rivet member through an opening in the die assembly to retain the plurality of parallel plates in parallel relationship while the die assembly is compressably retained between the first and second end plates.

It is yet another object of the invention to provide novel methods and meltblowing die assemblies coupleable to an adapter or an intermediate adapter having a mounting surface with a central first fluid outlet and a second fluid outlet for supplying first and second fluids to the die assembly, whereby the die assembly may be oriented in one of two directions distinguished by 90 degrees by mounting the die assembly on either the adapter or intermediate adapter. It is a related object of the invention to rotatably couple the die assembly to the intermediate adapter or to rotatably couple the adapter to a nozzle module to permit rotational orientation of the die assembly relative thereto.

It is still another object of the invention to provide novel meltblowing methods and systems including meltblowing die assemblies coupled to a fluid metering device for supplying a first fluid thereto, and to couple one or more die assemblies to a main manifold having corresponding first fluid supply conduits for supplying a first fluid from the fluid metering device to the one or more die assemblies. It is another object of the invention to couple the die assemblies to the main manifold with a plurality of corresponding nozzle modules, whereby each nozzle module supplies first and second fluids to the corresponding die assembly. And it is an alternative object of the invention to interconnect the die assemblies to the main manifold with a common nozzle adapter plate, which supplies first and second fluids to each of the plurality of die assemblies.

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators.

DETAILED DESCRIPTION OF THE INVENTION

Figure 1:
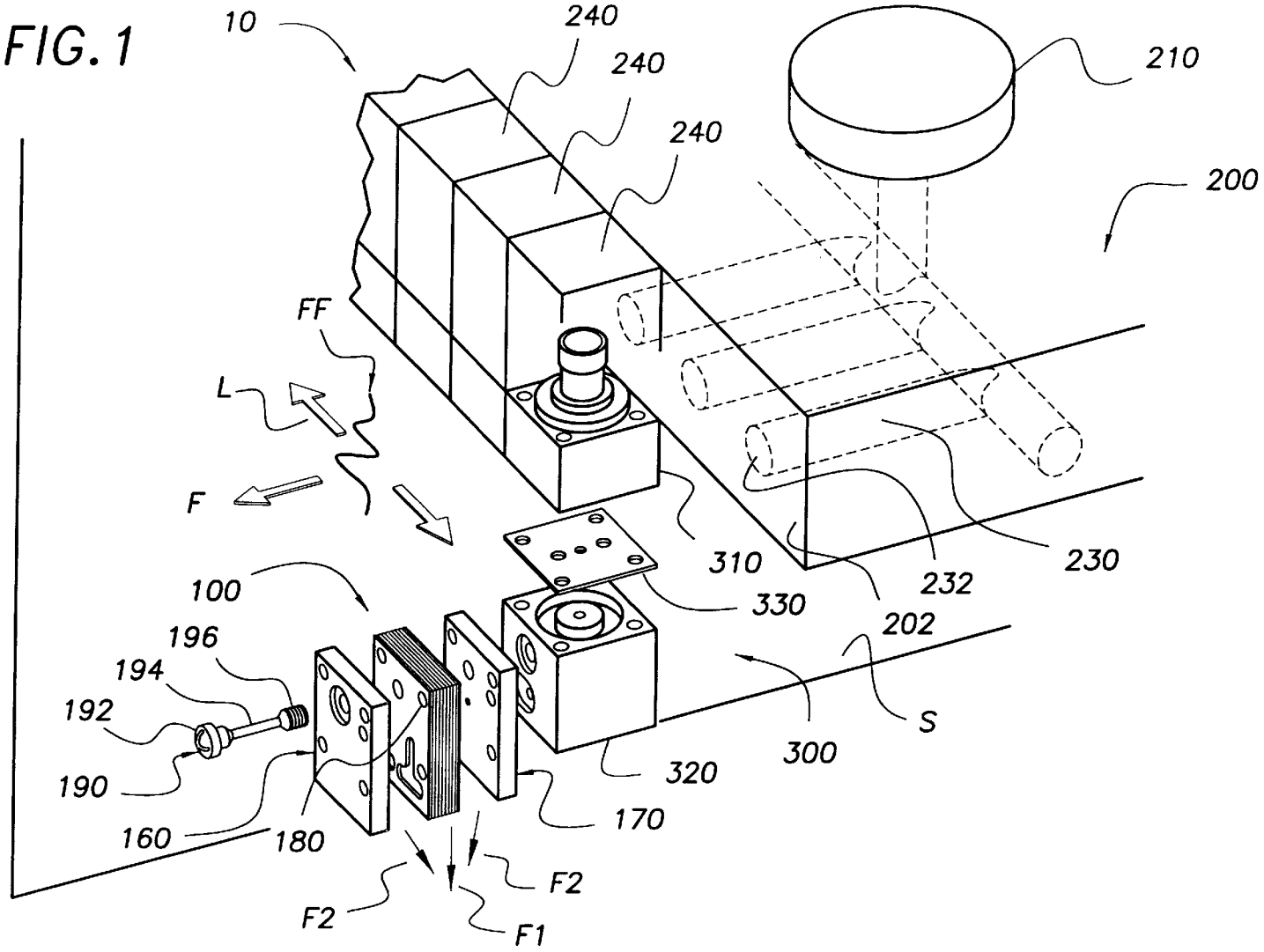
FIG. 1 is meltblowing system including an exploded view of a meltblowing die assembly comprising a plurality of parallel plates coupleable by an adapter to a manifold having a fluid metering device for supplying a first fluid to a plurality of meltblowing die assemblies similarly coupled to the manifold.

FIG. 1 is meltblowing system 10 useable for dispensing fluids, and particularly hot melt adhesives, onto a substrate S movable in a first direction F relative thereto. The system 10 includes generally one or more meltblowing die assemblies 100, an exemplary one of which is shown having a plurality of at least two parallel plates, coupleable to a manifold 200 having associated therewith a fluid metering device 210 for supplying a first fluid to the one or more meltblowing die assemblies through corresponding first fluid supply conduits 230. The system also has the capacity to supply a second fluid like heated air to the die assemblies as discussed more fully in the referenced copending U.S. application Ser. No. 08/683,064 filed Jul. 16, 1996 entitled "Hot Melt Adhesive Applicator With Metering Gear-Driven Head".

According to one aspect of the invention shown schematically in FIG. 1, a first fluid is dispensed from a first orifice of the die assembly 100 to form a first fluid flow F1 at a first velocity, and a second fluid is dispensed from two second orifices to form separate second fluid flows at a second velocity F2 along substantially opposing flanking sides of the first fluid flow F1. The first fluid flow F1 located between the second fluid flows F2 thus forms an array of first and second fluid flows. The second velocity of the second fluid flows F2 is generally greater than the first velocity of the first fluid flow F1 so that the second fluid flows F2 draw the first fluid flow, wherein the drawn first fluid flow is attenuated to form a first fluid filament. In the exemplary embodiment, the second fluid flows F2 are directed convergently toward the first fluid flow F1, but more generally the second fluid flows F2 are directed non-convergently relative to the first fluid flow F1 in parallel or divergently as disclosed more fully in the referenced copending U.S. application Ser. No. 08/717,080 filed Oct. 10, 1996 entitled "Meltblowing Method and Apparatus".

More generally, the first fluid is dispensed from a plurality of first orifices to form a plurality of first fluid flows F1, and the second fluid is dispensed from a plurality of second orifices to form a plurality of second fluid flows F2, wherein the plurality of first fluid flows and the plurality of second fluid flows are arranged in a series. In convergently directed second fluid flow configurations, the plurality of first fluid flows F1 and the plurality of second fluid flows F2 are arranged in a series so that each of the plurality of first fluid flows F1 is flanked on substantially opposing sides by corresponding convergently directed second fluid flows F2 as shown in FIG. 1, i.e. F2 F1 F2 F2 F1 F2 . . . . In non-convergently directed second fluid flow configurations, the plurality of first fluid flows F1 and the plurality of second fluid flows F2 are arranged in an alternating series so that each of the plurality of first fluid flows F1 is flanked on substantially opposing sides by one of the second fluid flows F2, i.e. F2 F1 F2 F1 F2 . . . , as disclosed more fully in the referenced copending U.S. application Ser. No. 08/717,080 filed Oct. 10, 1996 entitled "Meltblowing Method and Apparatus". The second velocity of the plurality of second fluid flows F2 is generally greater than the first velocity of the plurality of first fluid flows F1 so that the plurality of second fluid flows F2 draw the plurality of first fluid flows, wherein the drawn plurality of first fluid flows are attenuated to form a plurality of first fluid filaments. The plurality of first fluid flows F1 are generally alternatively directed divergently, or parallelly, or convergently.

According to another aspect of the invention, the plurality of first fluid flows F1 are dispensed from the plurality of first orifices at the same first fluid mass flow rate, and the plurality of second fluid flows F2 are dispensed from the plurality of second orifices at the same second fluid mass flow rate. The mass flow rates of the plurality of first fluid flows, however, is not necessarily the same as the mass flow rates of the plurality of second fluid flows. Dispensing the plurality of first fluid flows at equal first fluid mass flow rates provides improved first fluid flow control and uniform dispensing of the first fluid flows from the die assembly 100, and dispensing the plurality of second fluid flows at equal second fluid mass flow rates ensures more uniform and symmetric control of the first fluid flows with the corresponding second fluid flows as discussed further herein. In one embodiment, the plurality of first orifices have equal first fluid flow paths to provide the equal first fluid mass flow rates, and the plurality of second orifices having equal second fluid flow paths to provide the equal second fluid mass flow rates.

In convergently directed second fluid flow configurations, the two second fluid flows F2 convergently directed toward a common first fluid F1 generally have equal second fluid mass flow rates. Although the two second fluid mass flow rates associated with a first fluid flow are not necessarily equal to the two second fluid mass flow rates associated with another first fluid flow. In some applications, moreover, the two second fluid flows F2 convergently directed toward a common first fluid flow F1 may have unequal second fluid mass flow rates to affect a particular control over the first fluid flow. Also, in some applications the mass flows rates of some of the first fluid flows are not equal to the mass flow rates of other first fluid flows, for example first fluid flows dispensed along lateral edge portions of the substrate may have a different mass flow rates than other first fluid flows dispensed onto intermediate portions of the substrate to affect edge definition. Thus, while it is generally desirable to have equal mass fluid flow rates amongst first and second fluid flows, there are applications where it is desirable to vary the mass flow rates of some of the first fluid flows relative to other first fluid flows, and similarly to vary the mass flow rates of some of the second fluid flows relative to other second fluid flows.

FIG. 1 shows a first fluid flow F1 vacillating under the effect of the flanking second fluid flows F2, which for clarity are not shown. The first fluid flow F1 vacillation is characterizable generally by an amplitude parameter and a frequency parameter, which are controllable substantially periodically or chaotically depending upon the application requirements. The vacillation is controllable, for example, by varying a spacing between the first fluid flow F1 and one or more of the second fluid flows F2, or by varying the amount of one or more of the second fluid flows F2, or by varying a velocity of one or more of the second fluid flows F2 relative to the velocity of the first fluid flow F1. The amplitude and frequency parameters of the first fluid flow F1 are thus controllable with any one or more of the above variables as discussed more fully in copending U.S. application Ser. No. 08/717,080 filed Oct. 10, 1996 entitled "Meltblowing Method and Apparatus" incorporated herein by reference above.

The vacillation of the first fluid flow F1 is also controllable by varying a relative angle between one or more of the second fluid flows F2 and the first fluid flow F1. This method of controlling the vacillation of the first fluid flow F1 is useable in applications where the second fluid flows are convergent or non-convergent relative to the first fluid flow F1. Convergently directed second fluid flow configurations permit control of first fluid flow F1 vacillation with relatively decreased second fluid fluid mass flow rates in comparison to parallel and divergent second fluid flow configurations, thereby reducing heated air requirements. Generally, the first fluid flow F1 is relatively symmetric when the angles between the second fluid flows F2 on opposing sides of the first fluid flow F1 are equal. Alternatively, the vacillation of the first fluid flow F1 may be skewed laterally one direction or the other when the flanking second fluid flows F2 have unequal angles relative to the first fluid flow F1, or by otherwise varying other variables discussed herein.

According to another aspect of the invention shown in FIG. 1, a first fluid flow filament FF from any one of several die assemblies coupled to the main manifold, but not shown, is vacillated substantially periodically non-parallel to a direction F of substrate S movement. The corresponding die assembly generally includes a plurality of fluid flow filaments FF arranged in a series with the illustrated filament non-parallel to the direction F of substrate S movement. Still more generally, a plurality of similar die assemblies are coupled to the main manifold 200 in series, and/or in two or more parallel series which may be offset or staggered, and/or non-parallel to the direction F of substrate S movement. In the exemplary application, the plurality of die assemblies and the fluid flow filaments are vacillated in the directions L transversely to the direction F of the substrate S movement. In some applications, however, it may be advantageous and thus desirable to vacillate one or more of the first fluid flow filaments FF parallel to the direction F of substrate movement. This is particularly so along lateral edge portions of the substrate, where more precise control over application of the hot melt adhesive is desired, for example to effect a well defined edge profile, or boundary. According to this aspect of the invention, the first fluid flow filament FF may be vacillated parallelly to the direction F of substrate movement by orienting the series of first and second orifices of the die assembly parallel to the direction F of substrate movement as discussed further below.

The exemplary die assembly 100 of FIG. 1 includes a plurality of plates arranged in parallel and embodying many aspects of the invention as shown in FIGS. 2*a*–2*i*. The plates of FIG. 2 are assembled one on top of the other beginning with the plate in FIG. 2*a* on top and ending with the plate in FIG. 2*i* on bottom as a reference. The first and second fluids supplied to the die assembly 100, or body member, are distributed to the first and second orifices as discussed below. The first fluid is supplied from a first restrictor cavity inlet 110 to a first restrictor cavity 112 in the plate of FIG. 2*a*. The first fluid is substantially uniformly distributed from the first restrictor cavity 112 through a plurality of first orifices 118 in the plate of FIG. 2*b* to a first accumulator cavity 120 defined aggregately by the adjacent plates in FIGS. 2*c* and 2*d*. The plurality of first orifices also function as a fluid filter, entrapping any larger debris in the first fluid. The first fluid accumulated in the first accumulator cavity 120 is then supplied to a first plurality of slots 122 in the plate of FIG. 2*e*, which form the plurality of first orifices as discussed further below.

Figure 2A:
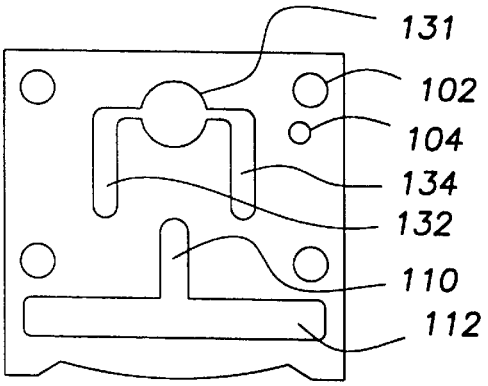
FIGS. 2*a*–2*i* represent a plurality of individual parallel plates of a die assembly, or body member, according to an exemplary embodiment of the invention.
Figure 2D:
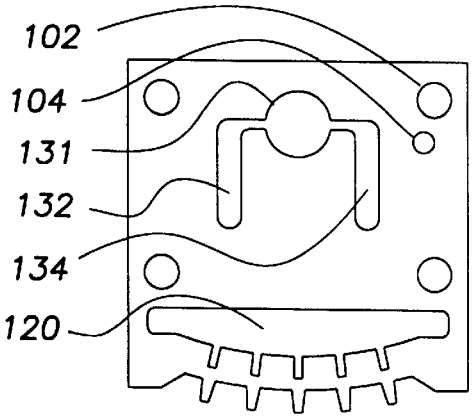
Figure 2B:
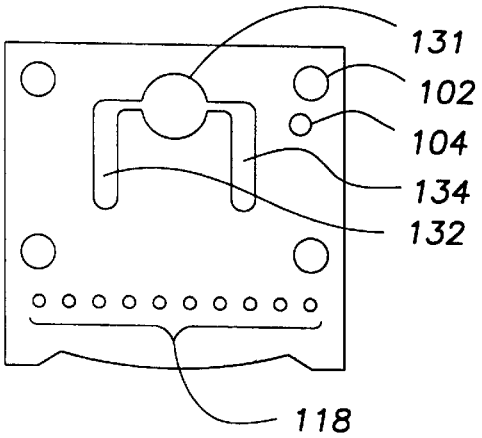
Figure 2E:
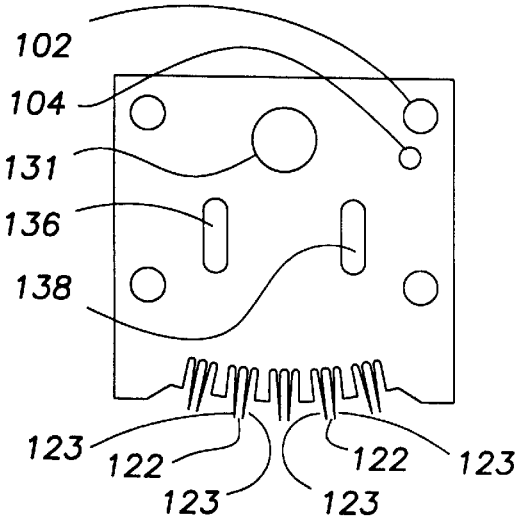
Figure 2C:
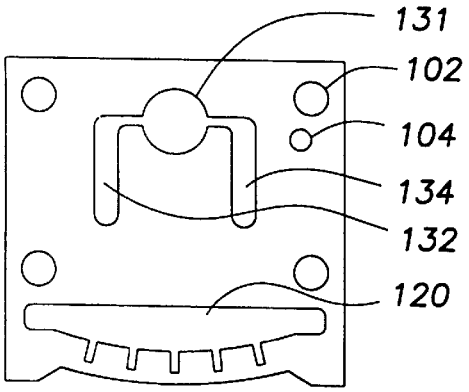
Figure 2F:
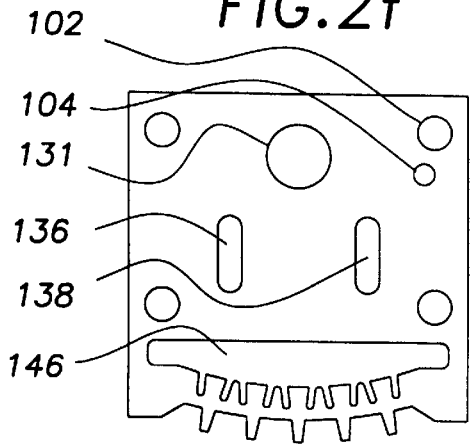
Figure 2G:
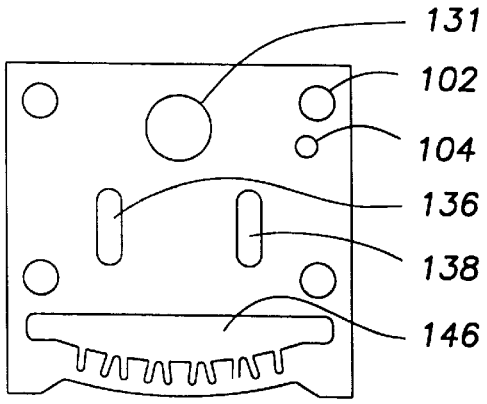
Figure 2I:
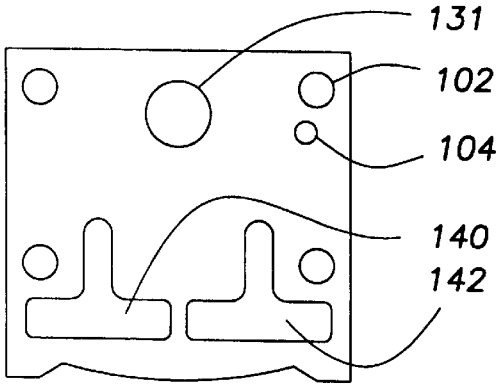

The second fluid is supplied from a second fluid inlet 131 to branched second fluid restrictor cavity inlet arms 132 and 134 formed in the plates of FIGS. 2*a*–2*d*, through corresponding passages 136 and 138 through the plates of FIGS. 2*e*–2*h*, and into separate second fluid restrictor cavities 140 and 142 in the plate of FIG. 2*i*. The second fluid is substantially uniformly distributed from the separate second restrictor cavities 140 and 142 through a plurality of second orifices 144 in the plate of FIG. 2*h* to a second accumulator cavity 146 defined aggregately by the adjacent plates in FIGS. 2*f* and 2*g*. The plurality of second orifices 144 also function as a fluid filter, entrapping any debris in the second fluid. The second fluid accumulated in the second accumulator cavity 146 is then supplied to a second plurality of slots 123 in the plate of FIG. 2*e*, which form the plurality of second orifices as discussed further below.

The plates of FIGS. 2*d* and 2*f* cover opposing sides of the plate in FIG. 2*e* to form the first and second orifices fluid dispensing orifices. In the exemplary embodiment of FIG. 2, the first orifices are oriented divergently relative to each other, and each first orifice has associated therewith two second orifices convergently directed toward the corresponding first orifice. This configuration is illustrated most clearly in FIG. 2*e*. According to a related aspect of the invention, the plurality of first and second orifices of FIG. 2*e* also have equal fluid flow paths as a result of the first and second slots 122 and 123 having similar length fluid flow paths formed radially along an arcuate path. The orifice size is generally between approximately 0.001 and approximately 0.060 inches per generally rectangular side, whereas in most meltblown adhesive applications the orifice size is between approximately 0.005 and approximately 0.060 inches per generally rectangular side. The first fluid filaments formed by the meltblowing processes discussed herein generally have diameters ranging between approximately 1 micron and approximately 1000 microns.

In alternative embodiments, the first and second orifices of the die assembly 100 may be oriented parallelly or divergently, and the die assembly may include an alternating series of first and second orifices. Additionally, the die assembly 100 may include plural arrays of serial first and second orifices arranged in parallel, non-parallel, offset parallel, and on different planer dimensions of the die assembly. These and other features are discussed more fully in copending U.S. application Ser. No. 08/717,080 filed Oct. 10, 1996 entitled "Meltblowing Method and Apparatus" incorporated herein by reference above, which other features are combineable with the many features and aspects of the present invention.

Figure 3A:
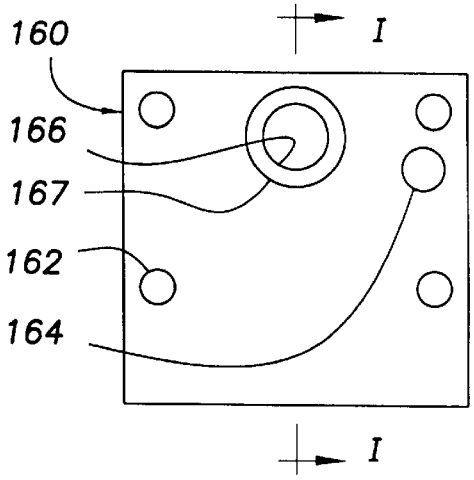
FIG. 3*a* is a frontal plan view of a first die retaining end plate for compressably retaining a die assembly of the type shown FIG. 2.
Figure 2H:
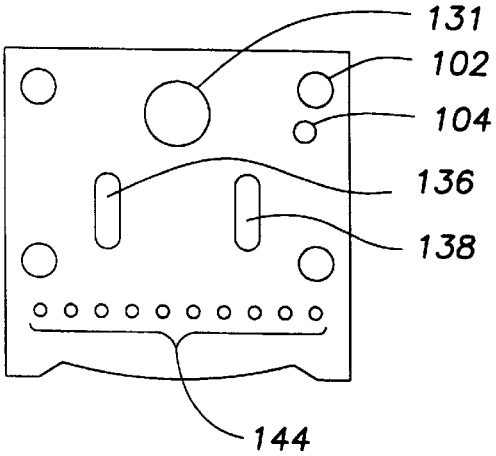
Figure 3B:
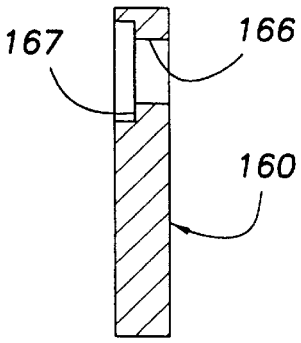
FIG. 3*b* is a sectional view along lines I—I of FIG. 3*a*.
Figure 4:
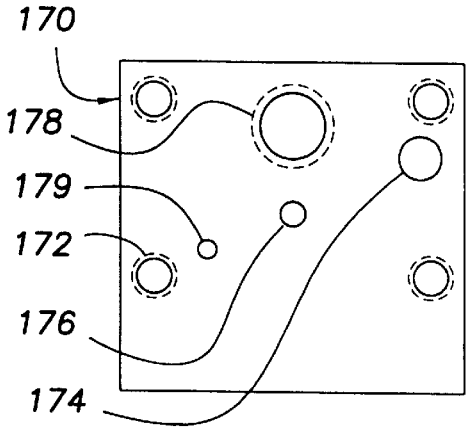
FIG. 4 is a frontal plan view of a second die retaining end plate for compressably retaining a die assembly in cooperation with the first die retaining end plate.

According to another aspect of the invention shown in FIGS. 1, 3 and 4, the die assembly 100 is compressedly retained between a first die retaining end plate 160 and a second opposing die retaining end plate 170. The die assembly 100 is retained therebetween by a plurality of bolt members, not shown for clarity, extendable through corresponding holes 162 in corners of the first end plate 160, through the corresponding holes 102 in the die assembly, and into the second end plate 170 wherein the bolt members are threadably engaged in corresponding threaded holes 172. The individual plates of FIG. 2 that compose the die assembly 100 thus are not bonded, or otherwise retained. The plate is preferably formed of a non-corrosive material like stainless steel.

FIG. 1 also shows the individual plates of the die assembly 100 retainable in parallel relationship by a single rivet member 180 disposeable through a corresponding hole 104, or opening, formed in each plate of the die assembly 100, which is shown in FIG. 2, wherein end portions of the rivet member 180 are protrudeable into corresponding recesses or holes 164 and 174 in the first and second end plates 160 and 170 when the die assembly 100 is compressably retained therebetween. The individual plates of the die assembly 100 are pivotally disposed, or fannable, about the rivet member 180 and are thus largely separable for inspection and cleaning. According to a related aspect of the invention, the rivet member 180 is installed when the die assembly 100 is compressably retained between the end plates 160 and 170, which precisely aligns the individual plates of the die assembly, by driving the rivet member 180 through holes through the end plates 160, 170 and through the die assembly plates.

Figure 5A:
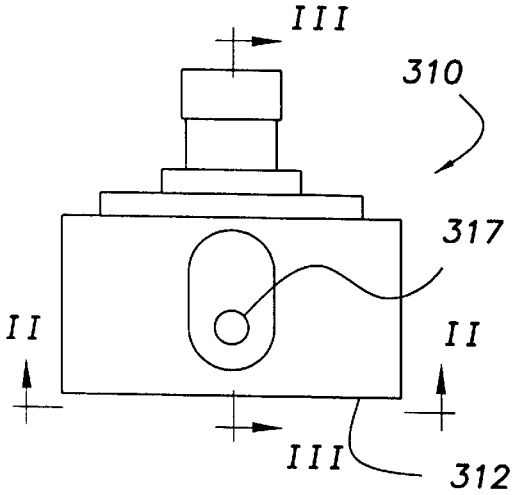
FIG. 5*a* is frontal plan view of a die assembly adapter.
Figure 5C:
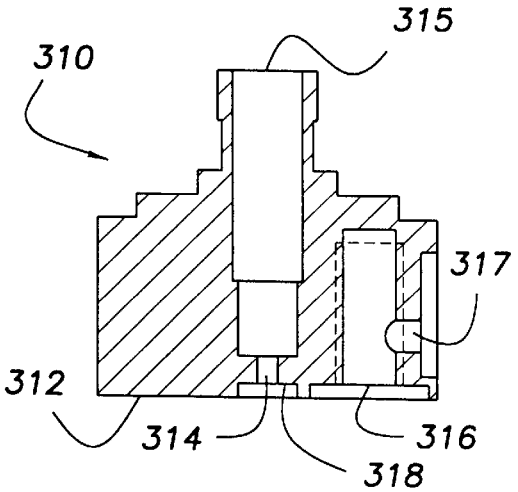
FIG. 5*c* is sectional view along lines III—III of FIG. 5*a*.
Figure 5B:
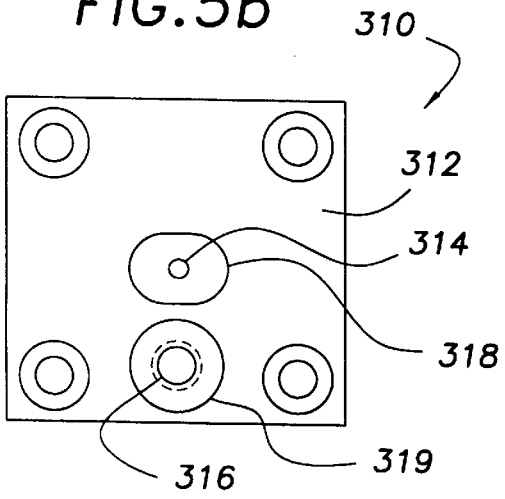
FIG. 5*b* is an end view along lines II—II of FIG. 5*a*.

FIG. 1 also shows the die assembly 100 retained between the first and second end plates 160 and 170 coupleable to an adapter assembly 300 comprising an adapter 310 and an intermediate adapter 320. FIGS. 5*a*–5*c* show various views of the adapter 310 having a first interface 312 for mounting either the die assembly 100 compressably retained between the end plates 160 and 170 directly or alternatively for mounting the intermediate adapter 320 as shown in the exemplary embodiment. The mounting interface 312 of the adapter 310 includes a first fluid outlet 314 coupled to a corresponding first fluid inlet 315, and a second fluid outlet 316 coupled to a corresponding second fluid inlet 317. The intermediate adapter 320 having a first mounting surface 322 with first and second fluid inlets 324 and 326 coupled to corresponding first and second fluid outlets 325 and 327 on a second mounting interface 321. The first mounting surface 322 of the intermediate adapter 320 is mountable on the first mounting interface 312 of the adapter 310 to couple the first and second fluid inlets 324 and 326 of the intermediate adapter 320 to the first and second fluid outlets 314 and 316 of the adapter 310.

Figure 6A:
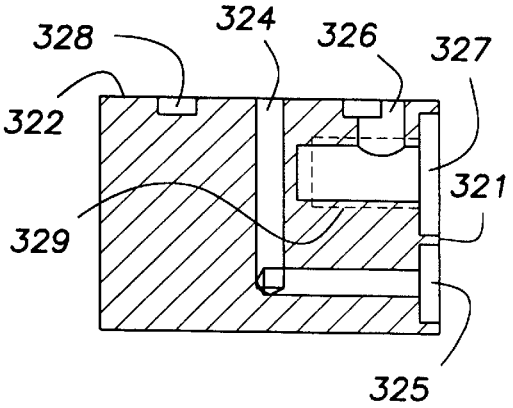
FIG. 6*a* is a sectional view along lines IV—IV of FIG. 6*b* of an intermediate adapter coupleable with the adapter of FIG. 5.
Figure 6B:
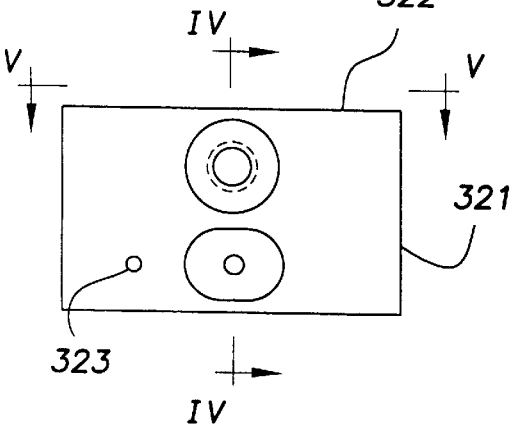
FIG. 6*b* is a frontal plan view of the intermediate adapter of FIG. 6*a*.
Figure 6C:
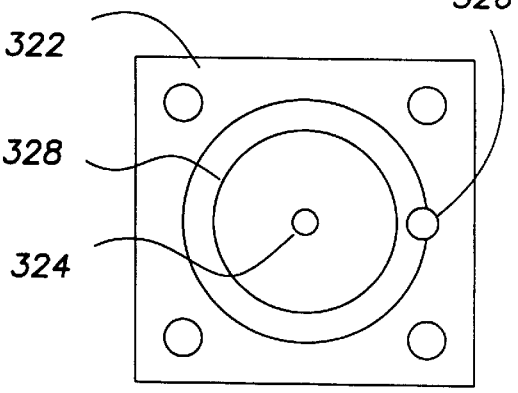
FIG. 6*c* is a top plan view along lines V—V of the intermediate adapter of FIG. 6*b*.

According to another aspect of the invention shown in FIGS. 5*b*, 6*a* and 6*c*, the first fluid outlet 314 of the adapter 310 is located centrally thereon for coupling with a centrally located first fluid inlet 324 of the intermediate adapter 320. The second fluid outlet 316 of the adapter 310 is located radially relative to the first fluid outlet 314 for coupling with a recessed annular second fluid inlet 328 coupled to the second fluid inlet 326 and disposed about the first fluid inlet 324 on the first interface 322 of the intermediate adapter 320. According to this aspect of the invention, the intermediate adapter 320 is rotationally adjustable relative to the adapter 310 to adjustably orient the die assembly 100 mounted thereon to permit alignment of the die assembly parallel or non-parallel to the direction F of substrate movement as discussed herein. And according to a related aspect of the invention, the adapter 310 also has a recessed annular second fluid inlet disposed about the first fluid inlet 315 and coupled to the second fluid outlet 316, whereby the adapter 310 is rotationally adjustable relative to a nozzle module 240 or other adapter for coupling the die assembly 100 to a first fluid supply as discussed further herein.

FIGS. 5*b* and 5*c* show the first interface of one of the adapter 310 or intermediate adapter 320 having first and second sealing member recesses 318 and 319 disposed about the first and second fluid outlets 314 and 316 on the first interface 312 of the adapter 310. A corresponding resilient sealing member like a rubber o-ring, not shown but known in the art, is seatable in each recess for forming a fluid seal between the adapter 310 and the intermediate adapter 320. The exemplary recesses are enlarged relative to the first and second fluid outlets 314 and 316 to accommodate misalignment between the adapter 310 and the intermediate adapter 320 and additionally to prevent contact between the first fluid and the sealing member, which may result in premature seal deterioration. Also, some of the recesses are oval shaped to more efficiently utilize the limited surface area of the mounting interface 312. The second fluid inlet 317 and other interfaces generally have a similar sealing member recess for forming a fluid seal with corresponding mounting members not shown.

FIG. 1 also shows a metal sealing member, or gasket, 330 disposeable between the adapter 310 and the intermediate adapter 320 for use in combination with the resilient sealing member discussed above or as an alternative thereto, which may be required in food processing and other applications. The metal sealing member 330 generally includes first and second fluid coupling ports, which may be enlarged to accommodate the resilient sealing members discussed above, and holes for passing bolt members therethrough during coupling of the adapter 310 and intermediate adapter 320.

As discussed herein, the die assembly 100 compressably retained between the first and second end plates 160 and 170 is coupleable either directly to the adapter 310 or to the intermediate adapter 320 thereby permitting mounting of the die assembly 100 in a parallel or vertical orientation, or in orientations shifted 90 degrees. FIG. 1 shows the die assembly 100 and die retaining end plates 160 and 170 mounted on the second mounting interface 321 of the intermediate adapter 320, but the mounting interfaces of the adapter 310 and the intermediate adapter 320 for this purpose are functionally equivalent. FIG. 4 shows the second die retaining end plate 170 having a first fluid inlet 176 and a second fluid inlet for coupling the first and second fluid inlets 112 and 132, 134 of the die assembly 100 with the first and second fluid outlets 325 and 327 of the intermediate adapter 320.

FIG. 1 shows a fastener 190 for fastening the die assembly 100 retained between the end plates 160 and 170 to the mounting surface of the adapter 320. The fastener 190 includes an enlarged head portion 192 with a torque applying engagement surface, a narrowed shaft portion 194, and a threaded end portion 196. FIG. 3*a* shows the first end plate 160 having an opening 166 for freely passing the threaded end portion 196 of the fastener 190 therethrough, and a seat 167 for receiving a sealing member, not shown, which forms a fluid seal with the enlarged head portion 192 of the fastener 190 advanced fully through the die assembly 100. The threaded end portion 196 of the fastener 190 is also freely passable through the second fluid inlet 131 of the die assembly 100 of FIG. 2, through the hole 178 in the second end plate 170, and into threaded engagement with a portion 329 of the second fluid outlet 327 of the intermediate adapter 320. According to this aspect of the invention, the fastener 190 is disposed through and into the second fluid outlet 327 of the adapter 320, or adapter 310 which is configured similarly, to fasten the die assembly 100 compressably retained between the first and second end plates 160 and 170, whereby the narrowed shaft portion 194 of the fastener 190 permits the second fluid flow therethrough without obstruction.

According to a related aspect of the invention, the hole 178 in the second end pate 170 is threaded to engage the threaded end portion 196 of the fastener thereby preventing separation thereof during assembly of the die assembly 100 and the end plates 160 and 170. According to another aspect of the invention, the fastener 190 extends through an upper portion of the die assembly 100 and die retaining end plates 160 and 170 to facilitate mounting thereof onto the mounting interface of the adapter 310 or 320. This upward location of the fastener 190 allows gravitational orientation of the die assembly relative to the adapter when mounting to substantially vertically oriented mounting interfaces. The adapter mounting interface and the second end plate 170 may also have complementary members for positively locating the second end plate 170 on the mounting interface. FIGS. 4 and 6*b*, for example, show for this purpose a protruding member 179 on the second end plate 170 and a complementary recess 323 on the second mounting interface 321 of the intermediate adapter 320.

According to yet another aspect of the invention shown in FIG. 1, the die assembly 100 is coupled to a fluid metering device 210 for supplying the first fluid to the die assembly. The die assembly is coupled to the main manifold 200 having a first fluid supply conduit 230 coupleable between the fluid metering device 210 and the die assembly 100 to supply first fluid thereto. The exemplary embodiment shows, more generally, accommodations for mounting a plurality of die assemblies 100 coupled to the main manifold 200, wherein the main manifold has a plurality of first fluid supply conduits 230 coupleable between the fluid metering device 210 and a corresponding one of the plurality of die assemblies 100 to supply first fluid thereto. The first fluid supply conduits 230 are coupled to a plurality of corresponding fluid outlet ports 232 disposed on a first end portion 202 of the main manifold 200, wherein the plurality of die assemblies 100 are coupled to the first end portion 202 of the main manifold 200.

In one application, each die assembly 100 and corresponding adapter 310 and or 320 is coupled to the main manifold 200 by a corresponding nozzle module 240 having an actuatable valve for controlling supply of first and second fluids to the die assembly, for example an MR-1300™ Nozzle Module, available from ITW Dynatec, Hendersonville, Tenn. In an alternative application, each die assembly 100 and corresponding adapter 310 and or 320 is coupled to the main manifold 200 by a common nozzle adapter plate, which supplies the first and second fluids to the plurality of die assemblies. According to this configuration, the modules 240 in FIG. 1 form the common adapter plate. These and other features and aspects of the invention are more fully disclosed in copending U.S. application Ser. No. 08/683,064 filed Jul. 16, 1996 entitled "Hot Melt Adhesive Applicator With Metering Gear-Driven Head", which other features are also combineable with the many features and aspects of the present invention.

In still another alternative application, each die assembly 100 and corresponding adapter 310 and or 320 is coupled to the main manifold 200 by a corresponding one of a plurality of individual first fluid flow control plates 240, which supplies first and second fluids to corresponding die assemblies. And in another alternative embodiment, each of the plurality of individual first fluid flow control plates 240 is also coupled to the main manifold 200 by the common fluid return manifold for returning first fluid to the main manifold. These and other features and aspects of the invention are more fully disclosed in copending U.S. application Ser. No. 08/734,400 filed Oct. 16, 1996 entitled "Fluid Flow Control Plates For Hot Melt Adhesive Applicator".

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A meltblowing method comprising:

dispensing a first fluid from a first orifice to form a first fluid flow at a first velocity;

dispensing a second fluid from not more than two second orifices associated with the first orifice to form separate second fluid flows at a second velocity along substantially opposing flanking sides of the first fluid flow;

convergently directing the separate second fluid flows toward the first fluid flow; and drawing the first fluid flow with the separate second fluid flows at a second velocity greater than the first velocity of the first fluid flow, wherein the drawn first fluid flow is attenuated to form a first fluid filament.

2. The method of claim 1 further comprising controlling a vacillation of the first fluid filament with the separate second fluid flows.

3. The method of claim 1 further comprising depositing the first fluid filament onto a moving substrate by vacillating the first fluid filament non-parallel to a direction of substrate movement.

4. The method of claim 1 further comprising:

dispensing the first fluid from a plurality of first orifices to form a plurality of first fluid flows at the first velocity;

dispensing the second fluid from a plurality of second orifices to form a plurality of second fluid flows at the second velocity, the plurality of first fluid flows and the plurality of second fluid flows arranged in a series so that each of the plurality of first fluid flows is flanked on substantially opposing sides by corresponding convergently directed second fluid flows;

drawing the plurality of first fluid flows with the corresponding convergently directed second fluid flows at the second velocity greater than the first velocity of the plurality of first fluid flows, wherein the drawn plurality of first fluid flows are attenuated to form a plurality of first fluid filaments.

5. The method of claim 4 further comprising divergently directing the plurality of first fluid flows.

6. The method of claim 5 further comprising dispensing the first fluid from the plurality of first orifices at equal mass flow rates, and dispensing the second fluid from the plurality of second orifices at equal mass flow rates.

7. The method of claim 4 further comprising directing the plurality of first fluid flows in parallel.

8. The method of claim 4 further comprising depositing first fluid filaments onto a moving substrate by vacillating the plurality of first fluid filaments non-parallel to a direction of substrate movement.

9. The method of claim 8 further comprising depositing first fluid filaments onto a moving substrate by vacillating the plurality of first fluid filaments substantially transverse to a direction of substrate movement.

10. The method of claim 1 further comprising dispensing the first fluid from a first orifice protruding relative to the second orifices associated with the first orifice.

11. The method of claim 10 further comprising dispensing the second fluid from the second orifices recessed in corresponding apertures relative to the first orifice.

12. The method of claim 4 further comprising dispensing the first fluid from a plurality of first orifices protruding relative to the plurality of second orifices.

13. The method of claim 12 further comprising dispensing the second fluid from a plurality of second orifices recessed in corresponding apertures relative to the plurality of first orifices.

14. The method of claim 1 further comprising vacillating the first fluid filament in a plane containing the first fluid flow and the separate second fluid flows.

15. The method of claim 1 further comprising vacillating the first fluid filament substantially periodically.

16. The method of claim 4 further comprising vacillating the plurality of first fluid filaments in a plane containing the plurality of first fluid flows and the plurality of second fluid flows.

17. The method of claim 4 further comprising vacillating the plurality of first fluid filaments substantially periodically.

18. A meltblowing method comprising:

dispensing a first fluid from a plurality of first orifices at equal mass flow rates to form a plurality of first fluid flows at a first velocity;

dispensing a second fluid from a plurality of second orifices to form a plurality of second fluid flows at a second velocity, the plurality of first fluid flows and the plurality of second fluid flows arranged in a series so that each of the plurality of first fluid flows is flanked on substantially opposing sides by corresponding second fluid flows;

drawing the plurality of first fluid flows with the plurality of second fluid flows at a second velocity greater than the first velocity of the plurality of first fluid flows;

non-convergently directing the plurality first fluid flows and the plurality of second fluid flows, wherein plurality of first fluid flows are attenuated to form a plurality of first fluid filaments.

19. The method of claim 18 further comprising dispensing the second fluid from the plurality of second orifices at equal mass flow rates.

20. A meltblowing apparatus comprising:

a first orifice in a body member for dispensing a first fluid and forming a first fluid flow;

not more than two second orifices in the body member associated with the first orifice for dispensing a second fluid and forming two second fluid flows;

the first orifice protruding relative to the second orifices, and the first orifice and the two second orifices arranged so that the first orifice is flanked on substantially opposing sides by the two second orifices, the two second orifices oriented to convergently direct the two second fluid flows toward the first fluid flow.

21. The apparatus of claim 20 further comprising:

a plurality of first orifices in the body member for dispensing the first fluid and forming a plurality of first fluid flows;

a plurality of second orifices in the body member for dispensing the second fluid and forming a plurality of second fluid flows;

the plurality of first orifices protruding relative to the plurality of second orifices, and the plurality of first orifices and the plurality of second orifices arranged in a series so that each of the plurality of first orifices is flanked on substantially opposing sides by corresponding second orifices oriented to convergently direct two second fluid flows toward each first fluid flow.

22. The apparatus of claim 21, the plurality of first orifices are oriented to direct the plurality of first fluid flows in parallel.

23. The apparatus of claim 21, the plurality of first orifices are oriented to divergently direct the plurality of first fluid flows.

24. The apparatus of claim 21, the plurality of first orifices having equal first fluid flow paths, and the plurality of second orifices having equal second fluid flow paths.

25. The apparatus of claim 21, the body member is a die assembly comprising:

a first plate forming a first restrictor cavity in the body member, the first restrictor cavity having a first restrictor cavity inlet and a first restrictor cavity outlet;

a second plate forming first accumulator cavity in the body member, the first accumulator cavity having a first accumulator cavity inlet coupled to the first restrictor cavity outlet, and the first accumulator cavity having a first accumulator cavity outlet coupled to the plurality of first orifices, wherein first fluid supplied to the first restrictor cavity inlet is substantially uniformly distributed to the plurality of first orifices to form the plurality of first fluid flows.

26. The apparatus of claim 25, the body member further comprising a third plate between the first plate and the second plate, the third plate having a plurality of first passages coupling the first restrictor cavity and the first accumulator cavity, wherein the plurality of passages in the third plate are dimensioned to substantially uniformly distribute the first fluid supplied from the first restrictor cavity to the plurality of first orifices.

27. The apparatus of claim 25, the body member further comprising:

a fourth plate forming a second restrictor cavity in the body member, the second restrictor cavity having a second restrictor cavity inlet and a second restrictor cavity outlet;

a fifth plate forming a second accumulator cavity in the body member, the second accumulator cavity having a second accumulator cavity inlet coupled to the second restrictor cavity outlet, and the second accumulator cavity having a second accumulator cavity outlet coupled to the plurality of second orifices, wherein second fluid supplied to the second restrictor cavity inlet is substantially uniformly distributed to the plurality of second orifices to form the plurality of second fluid flows.

28. The apparatus of claim 27, the body member further comprising a sixth plate between the fourth plate and the fifth plate, the sixth plate having a plurality of second passages coupling the second restrictor cavity and the second accumulator cavity, wherein the plurality of passages in the sixth plate substantially uniformly distribute the second fluid supplied from the second restrictor cavity to the plurality of second orifices.

29. The apparatus of claim 27, the body member further comprising a seventh plate having a first plurality of slots and a second plurality of slots, the first plurality of slots forming the first plurality of orifices coupled to the first accumulator cavity and the second plurality of slots forming the second plurality of orifices coupled to the second accumulator cavity.

30. The apparatus of claim 29, the plurality of first slots forming the plurality of first orifices having equal first fluid flow paths.

31. The apparatus of claim 29, the plurality of second slots forming the plurality of second orifices having equal second fluid flow paths.

32. The apparatus of claim 30, the plurality of first orifices are oriented to direct the plurality of first fluid flows in parallel.

33. The apparatus of claim 30, the plurality of first orifices are oriented to divergently direct the plurality of first fluid flows.

34. The apparatus of claim 20, the second orifices disposed in a corresponding aperture of the body member to recess the second orifices in the body member relative to the first orifice.

35. The apparatus of claim 21, the plurality of second orifices disposed in corresponding apertures of the body member to recess the second orifices in the body member relative to the first orifice.

36. A meltblowing apparatus comprising:

a first orifice in a die assembly including at least two parallel plates for dispensing a first fluid and forming a first fluid flow;

two second orifices in the die assembly for dispensing a second fluid and forming two second fluid flows;

the first orifice and the two second orifices arranged so that the first orifice is flanked on substantially opposing sides by the two second orifices;

first and second opposing die retaining end plates for compressably retaining the die assembly therebetween; and an adapter having a first mounting interface for mounting the die assembly compressedly retained between the two opposing die retaining end plates.

37. The meltblowing apparatus of claim 36, further comprising a single rivet member disposed through an opening through the die assembly to retain the plurality of parallel plates in parallel relationship.

38. The apparatus of claim 36, the first mounting interface of the adapter having a first fluid outlet and a second fluid outlet, and the second die retaining end plate having a first fluid inlet and a second fluid inlet, wherein the second die retaining end plate is mountable on the first mounting interface of the adapter to couple the first and second fluid outlets of the adapter to the first and second fluid inlets of the second die retaining end plate.

39. The apparatus of claim 38 further comprising a fastener, the first die retaining end plate having a fastener opening, the fastener extendable through the fastener opening of the first die retaining end plate, through the die assembly, through the second fluid inlet of the second die retaining end plate, and into the second fluid outlet of the adapter mounting interface to fasten the die assembly compressedly retained between the first and second die retaining end plates to the adapter mounting interface.

40. The apparatus of claim 39, the fastener opening located toward an upper end of the first die retaining end plate, and the second die retaining end plate having a locating member engageable with a complementary member on the adapter mounting interface to align the second die retaining end plate on the adapter mounting interface.

41. The apparatus of claim 36 further comprising an intermediate adapter having a first mounting interface with a central first fluid inlet and an annular second fluid inlet, a central first fluid outlet and a second fluid outlet on the first mounting interface of the adapter;

the first mounting interface of the intermediate adapter mountable on the first mounting interface of the adapter to couple the first and second fluid inlets of the intermediate adapter to the first and second fluid outlets of the adapter, whereby the annular second fluid inlet permits rotational positioning of the intermediate adapter relative to the adapter, the intermediate adapter having a second mounting interface with a first fluid outlet and a second fluid outlet, and the second die retaining end plate having a first fluid inlet and a second fluid inlet, the second die retaining end plate mountable on the second mounting interface of the intermediate adapter to couple the first and second fluid outlets of the intermediate adapter to first and second fluid inlets of the die assembly.

42. A meltblowing apparatus comprising:

a plurality of first orifices in a body member for dispensing a first fluid and forming a plurality of first fluid flows;

a plurality of second orifices in the body member for dispensing a second fluid and forming a plurality of second fluid flows;

the plurality of first orifices and the plurality of second orifices arranged in a series so that each of the plurality of first orifices is flanked on substantially opposing sides by corresponding second orifices, the plurality of first orifices protruding relative to the plurality of second orifices, and at least some adjacent first orifices of the series separated by at least two adjacent second orifices of the series.

43. The meltblowing apparatus of claim 42, the body member is a die assembly comprising a plurality of at least two parallel plates, the plurality of first orifices and the plurality of second orifices formed in at least one of the two parallel plates of the die assembly.

44. The apparatus of claim 43, each plate not thicker than approximately 0.030 inches.

45. The apparatus of claim 43, each plate having a thickness between approximately 0.005 inches and approximately 0.025 inches.

46. A meltblowing system comprising:

a die assembly including a plurality of at least two parallel plates, the die assembly having a first orifice for dispensing a first fluid and forming a first fluid flow, and two second orifices for dispensing a second fluid and forming two second fluid flows; and a fluid metering device coupled to the die assembly for supplying the first fluid thereto.

47. The system of claim 46 further comprising a main manifold having a first fluid supply conduit coupleable between the fluid metering device and the die assembly to supply first fluid thereto.

48. The system of claim 34 further comprising a plurality of die assemblies coupled to the main manifold, the main manifold having a plurality of first fluid supply conduits coupleable between the fluid metering device and a corresponding one of the plurality of die assemblies to supply first fluid thereto.

49. The system of claim 48, the main manifold having a first end portion with a plurality of fluid outlet ports, each fluid outlet port coupled to a corresponding one of the first fluid supply conduits, wherein the plurality of die assemblies are coupled to the first end portion of the main manifold.

50. The system of claim 48 further comprising a plurality of nozzle modules, at least some of the plurality of die assemblies coupled to the main manifold by a corresponding one of the plurality of nozzle modules, each of the nozzle modules supplying the first and second fluids to the corresponding die assembly.

51. The system of claim 48 further comprising a common nozzle adapter plate for interconnecting each of the plurality of die assemblies to the main manifold, the common nozzle adapter plate supplying the first and second fluids to each of the plurality of die assemblies.

52. The system of claim 48 further comprising a plurality of individual first fluid flow control plates, each of the plurality of individual first fluid flow control plates coupling a corresponding one of the plurality of die assemblies to the main manifold.

53. The system of claim 52 further comprising a common fluid return manifold, each of the plurality of individual first fluid flow control plates coupleable to the main manifold by the common fluid return manifold for returning first fluid to the main manifold.

* * * * *

UNITED STATES PATENT AND TRADEMARK OFFICE
Certificate

Patent No. 5,904,298 Patented: May 18, 1999

On petition requesting issuance of a certificate for correction of inventorship pursuant to 35 U.S.C. 256, it has been found that the above-identified patent, through error and without deceptive intent, improperly sets forth the inventorship.

Accordingly, it is hereby certified that the correct inventorship of this patent is: Kui-Chiu Kwok, Mundelein, IL; Donald Van Erden, Wildwood, IL; Hugh J. Zentmyer, Green Oaks, IL; Edward W. Bolyard Jr., Old Hickory, TN; Leonard E. Riggan Jr., Nashville, TN Signed and Sealed this Ninth Day of May, 2000.

ANDRES KASHNIKOW
*Supervisory Patent Examiner*
Art Unit 3752